US008746961B2

(12) United States Patent
Hansen

(10) Patent No.: US 8,746,961 B2
(45) Date of Patent: Jun. 10, 2014

(54) METHOD, APPARATUS, SYSTEM AND HEAT EXCHANGER FOR INCREASING THE TEMPERATURE OF A SUBSTANCE WHICH IS INITIALLY IN AN AT LEAST PARTLY SOLIDIFIED STATE IN A CONTAINER

(75) Inventor: Anders Kromand Hansen, Brabrand (DK)

(73) Assignee: Aarhuskarlshamn Denmark A/S, Aarhus C (DK)

( * ) Notice: Subject to any disclaimer, the term of this patent is extended or adjusted under 35 U.S.C. 154(b) by 1821 days.

(21) Appl. No.: 11/578,933

(22) PCT Filed: Apr. 20, 2005

(86) PCT No.: PCT/DK2005/000268

§ 371 (c)(1),
(2), (4) Date: Aug. 17, 2007

(87) PCT Pub. No.: WO2005/103594

PCT Pub. Date: Nov. 3, 2005

(65) Prior Publication Data

US 2008/0264601 A1 Oct. 30, 2008

Related U.S. Application Data

(60) Provisional application No. 60/564,576, filed on Apr. 23, 2004.

(30) Foreign Application Priority Data

Apr. 23, 2004 (DK) ..... 2004 00644

(51) Int. Cl.

| | |
|---|---|
| ***B01F 15/06*** | (2006.01) |
| ***B28D 1/06*** | (2006.01) |
| ***F28F 1/00*** | (2006.01) |

(52) U.S. Cl.

USPC ..... 366/144; 366/147; 366/177.1; 366/173.2; 165/74; 165/132; 165/135; 165/158; 165/179; 126/392.1

(58) Field of Classification Search

USPC ..... 366/147, 144, 177.1, 173.2; 165/74, 165/132, 135, 158, 179; 126/392.1

See application file for complete search history.

(56) References Cited

U.S. PATENT DOCUMENTS 981,098 A * 1/1911 McCaskell ..... 422/224
1,892,197 A * 12/1932 Zerwer ..... 165/81

(Continued)

FOREIGN PATENT DOCUMENTS

EP 0 860 673 8/1998
GB 122 563 1/1919

(Continued)

OTHER PUBLICATIONS

XP-002330982, Feb. 9, 1989, Prikaspiskkirdostro.

(Continued)

*Primary Examiner* — Tony G Soohoo
(74) *Attorney, Agent, or Firm* — Day Pitney LLP

(57) ABSTRACT

One aspect of the present invention relates to a method for increasing the temperature of a substance which is initially in an at least partly solidified state in a container, where at least one heat exchanger is arranged in the container. One object is to obtain that the temperature of a substance may be changed relatively fast. This is obtained by having pumping means for displacing the substance, exchanging heat between a heat exchanger and the substance, displacing substance with the pumping means for increased heat exchange between the heat exchanger and the substance, as well as stirring the substance with the pumping means by displacing the substance inside the container. When the substance is displaced, then not only stagnant substance is in contact with the heat exchanger for heat exchange. The amount of substance in contact with the heat exchanger is thereby greatly increased, and the heat transfer is less dependent on thermal conductivity of the substance.

7 Claims, 8 Drawing Sheets

(56) References Cited

U.S. PATENT DOCUMENTS

Figure 1B:
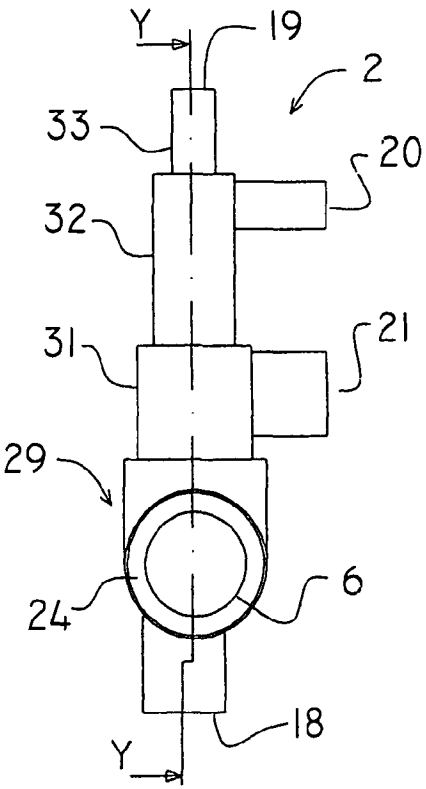

| | | | | | |
|---|---|---|---|---|---|
| 2,482,908 | A * | 9/1949 | Hammond et al. | 435/246 |
| 2,522,948 | A * | 9/1950 | Hoffmann | 62/392 |
| 2,747,844 | A * | 5/1956 | Slayter | 366/167.1 |
| 2,800,307 | A * | 7/1957 | Putney | 165/108 |
| 3,125,537 | A * | 3/1964 | Martin | 366/147 |
| 3,133,590 | A * | 5/1964 | Lowe | 165/280 |
| 3,681,566 | A * | 8/1972 | Sellers | 392/456 |
| 3,757,745 | A * | 9/1973 | Miller | 122/136 R |
| 3,759,318 | A * | 9/1973 | Putney et al. | 165/108 |
| 3,776,199 | A * | 12/1973 | Miller | 122/33 |
| 3,814,178 | A * | 6/1974 | Parussel | 165/158 |
| 3,818,938 | A * | 6/1974 | Carson | 366/167.1 |
| 3,856,078 | A * | 12/1974 | Dahl | 165/108 |
| 3,937,276 | A * | 2/1976 | Ostwald | 165/135 |
| 4,595,046 | A | 6/1986 | Iino | |
| 4,599,990 | A * | 7/1986 | Fritzsche et al. | 126/374.1 |
| 4,622,135 | A * | 11/1986 | Williams | 210/167.28 |
| 4,623,544 | A * | 11/1986 | Highnote | 426/233 |
| 4,661,684 | A * | 4/1987 | Sellers | 392/308 |
| 4,941,330 | A * | 7/1990 | Williamson | 62/515 |
| 4,962,698 | A * | 10/1990 | Drijftholt et al. | 99/408 |
| 5,884,814 | A | 3/1999 | Nelson | |
| 6,002,838 | A * | 12/1999 | Nir | 392/449 |
| 6,095,037 | A * | 8/2000 | Savage et al. | 99/408 |
| 6,115,542 | A * | 9/2000 | Nir | 392/449 |
| 6,365,114 | B1 * | 4/2002 | Marold | 422/200 |
| 6,877,552 | B1 | 4/2005 | King | |
| 7,614,366 | B2 * | 11/2009 | Arnold et al. | 122/18.1 |
| 2002/0069767 | A1 * | 6/2002 | Wendel et al. | 99/403 |
| 2008/0023039 | A1 * | 1/2008 | Hancock | 134/22.18 |
| 2008/0023040 | A1 * | 1/2008 | Hancock | 134/22.18 |
| 2008/0023050 | A1 * | 1/2008 | Hancock | 134/99.2 |
| 2008/0073444 | A1 * | 3/2008 | Blechschmitt et al. | 239/8 |
| 2008/0074944 | A1 * | 3/2008 | Blechschmitt et al. | 366/101 |
| 2008/0264601 | A1 * | 10/2008 | Hansen | 165/47 |
| 2009/0014156 | A1 * | 1/2009 | Vetrovec | 165/104.31 |

FOREIGN PATENT DOCUMENTS

| | | | | |
|---|---|---|---|---|
| GB | 264 377 | | 1/1927 | |
| GB | 994 326 | | 6/1965 | |
| GB | 1 149 974 | | 4/1969 | |
| GB | 1 286 971 | | 8/1972 | |
| GB | 2 144 526 | | 3/1985 | |
| JP | 48-030456 | | 4/1971 | |
| JP | 57049786 | A * | 3/1982 | F28D 7/06 |
| JP | 64-038467 | | 3/1989 | |
| JP | 08-247685 | | 9/1996 | |
| JP | 2003-210101 | | 7/2003 | |
| WO | WO 95/15287 | | 6/1995 | |

OTHER PUBLICATIONS

Chinese Office Action issued in related CN Application No. 2005800126456 dated Mar. 21, 2008 (in the Chinese and English languages, English translation prepared by Chinese agent).

English language translation of Japanese Office Action issued in related JP Application No. 2007-508728, May 14, 2010 (translation prepared by Japanese agent).

International Search Report issued in related Application No. PCT/DK2005/000268, Jun. 21, 2005.

Written Opinion issued in related international application No. PCT/DK2005/000268.

International Preliminary Report on Patentability issued in related international application No. PCT/DK2005/000268, completed May 23, 2006.

SPRO International-Type Search Report issued in related DK application No. 0644/2004, Oct. 15, 2004.

* cited by examiner

METHOD, APPARATUS, SYSTEM AND HEAT EXCHANGER FOR INCREASING THE TEMPERATURE OF A SUBSTANCE WHICH IS INITIALLY IN AN AT LEAST PARTLY SOLIDIFIED STATE IN A CONTAINER

CROSS REFERENCE TO RELATED APPLICATION

This application is based on U.S. Patent Application Ser. No. 60/564,576, filed Apr. 23, 2004, a provisional application on which a claim for convention priority in the present application is based.

The present invention relates to a method for increasing the temperature of a substance which is initially in an at least partly solidified state in a container, where at least one heat exchanger is arranged in the container. The invention further relates to an apparatus, a system and a heat exchanger.

Usually tanks for holding substances may be equipped with a spiral heat exchanger submerged in the substance or with a helical heat exchanger wound around the tank for heating such substance. The heating of the substance may be done for different purposes, e.g. to cook the substance, to change the viscosity of the substance, to speed up a chemical process between compounds in the substance, etc.

The active surface of the heat exchanger is heated to a temperature at least as high as the desired temperature of the substance, i.e. a temperature difference is present. In order to obtain the desired temperature in a short time, the temperature difference is normally increased. In case the substance, or one or more fractions of the substance, is/are sensitive to high temperatures the temperature of the heat exchanger must, however, be kept under or equal to an allowed maximum temperature. For some substances, the maximum temperature may be quite low, and if a large amount of the substance is placed in a tank, the time for heating the substance may be very long. The same issue is present also when cooling a substance. The phenomenon is also known from a snow man. When snow is packed in large balls, as it is in a snow man, it takes very long to thaw, compared with the same amount of snow lying unpacked as it has fallen on a lawn.

An example of a situation where temperature change is quite long is bulk vegetable oil in a plastic container. Such plastic containers are known e.g. as a flexitank or similar with a capacity of one to many thousand liters, such as available at Trans Ocean Distribution (www.todbulk.com), or at John S Braid & Co Ltd (www.braidco.com). During transport the ambient temperature may be below the melting point of the oil, whereby the oil gradually solidifies. In order to empty the container, the solidified oil must be melted at the final destination. The container is therefore from the beginning placed on a heating blanket before it is filled with oil. After arrival to the final destination, the heating blanket must be activated for several days, e.g. four to five days depending on the size of the container, before the oil is melted and can be tapped. The long duration is primarily caused by the large quantity of oil and the fact that the temperature of the heat blanket must be limited. The limitation is caused by the plastic material from which the container is made, which can only endure a certain temperature, and more important that the vegetable oil will degrade sincerely in quality if heated too much. Also, the pressure of the heating media (water or steam) cannot be increased further as the pipes in the heating blanket and the fittings are not dimensioned to sustain the increased loads from a higher pressure.

Another heating system is described in U.S. Pat. No. 2,522,948 used to cool water or some other liquid. The liquid is pumped into a tank through a heat exchanger consisting of a number of parallel pipes within a shell. Having passed the pipes, the cooled liquid then runs out of the other open end of the shell farthest inside the tank and blends with the rest of the liquid. The liquid is pumped out from an outlet at the bottom of the tank and circulated until the desired temperature is reached. Although the heat exchanger can probably be used for heating as well, the pump can only work on liquids and not on a substance being initially partly solidified and non-pumpable. Furthermore, the exchange of heat between the heat exchanged liquid and the remaining substance can not be very effective as the liquid is merely circulated around the system, and the mixing then only takes place close to the interior end of the heat exchanger. This leads to large temperature differences at different locations inside the tank and a longer overall cooling time. Also the system takes up a considerably amount of space outside the tank as the liquid, and thereby the piping, leaves the tank from one end and enters approximately in the other. Several fittings to and openings in the tank are thus required as well as access to the main part of the outside of the tank, which is not always practical.

U.S. Pat. No. 6,002,838 describes a tank for storing and discharging liquids being heated during the discharge. The tank is divided into two chambers with only a relatively small opening in between and with a heat exchanger placed in the smallest chamber. The liquid is pumped through the exchanger and out, where some of it is discharged right away, and the rest is pumped into the small chamber again. As also the case in the previous described patent, some of the liquid is recirculated to help heating up the remaining fluid. However, no stirring effect is obtained. Also, the method described above involves the special design of a storage tank with built in chambers, and the method is thus not applicable on standard tanks. Finally, the method can not solve the problem of heating a substance, which initially is not in a pumpable state.

One object is to obtain that the temperature of an entire tank full of a substance, which is initially in an at least partly solidified state, may be increased relatively fast. Another object is to obtain a relatively fast increase in temperature, also when only a limited temperature difference or maximum temperature is allowed.

Further objects appear from the description elsewhere.

Accordingly, the invention provides a method of increasing the temperature of a substance where the substance is initially in an at least partly solidified state as claimed in claim 1, where pumping means for displacing the substance are provided, said method comprising the steps of:

a) exchanging heat between the heat exchanger and the substance, b) displacing substance with the pumping means for increased heat exchange between the heat exchanger and the substance, c) stirring the substance with the pumping means by displacing the substance inside the container.

When the substance, which is initially in an at least partly solidified state, is displaced according to step b), then not only stagnant substance is in contact with the heat exchanger for heat exchange according to step a). The amount of substance in contact with the heat exchanger is thereby greatly increased, and the heat transfer is less dependent on the thermal conductivity of the substance. When the substance is further stirred according to step c), it is obtained that the substance after contact with the heat exchanger is transported away from the heat exchanger and mixed with the remaining substance, whereby heat exchange will also take place between the heat exchanged substance and the remaining substance, which is a great improvement compared to only exchanging heat with the heat exchanger. It is also obtained by step c) that substance placed away from the heat exchanger is transported to the heat exchanger, whereby the heat exchanger may exchange heat with all the substance in short time, which again reduces dependency on the thermal conductivity of the substance.

The method may preferably involve that the heat exchanger is connected to external source means for transferring heat to the substance in the container, and where the source means and the pumping means are coordinated by control means for controlling the temperature of the substance. In this way the external source means for transferring heat to or from the substance need only to be provided at the location where the heat transfer is to be done. By coordinating the source means and the pumping means, a more lenient handling of the substance may be obtained, e.g. by regulating the amount of substance pumped per time unit in relation to the amount of heat being transferred to or from the source means, such as e.g. to prevent overheating and furthermore obtaining full control of the temperature range of the substance.

The heat exchanger may preferably comprise an oblong cylindrical surface, and guiding means be provided for guiding the substance along said surface when performing step b), said guiding means being connected to the pumping means. When the substance is guided along a surface of a heat exchanger, enhanced heat transfer is obtained between the substance and the heat exchanger since the substance may interact with the heat exchanger along the surface and not be restricted to a certain limited part of the surface.

The guiding means may in a preferred embodiment comprise a housing arranged essentially concentrically around the heat exchanger, said housing comprising a number of openings arranged in a pattern along the length of the housing to distribute the substance when performing step c). Hereby improved heat transfer between the substance and the heat exchanger is obtained, as well as a stirring effect of the substance when it is distributed via the openings. Compared to transferring heat to or from a substance, which is in a static state, the distribution and the resulting stirring effect greatly improve heat transfer to or from the entire amount of substance. In case the method involves melting solidified substance it is obtained, due to the guiding means comprising a housing arranged essentially concentrically around the heat exchanger, that substance contained in the guiding means may be melted with heat from the heat exchanger at first, where after the melted substance may be distributed to the remaining part of the substance, which is still solidified, whereby direct transfer of heat to that part may be obtained.

Step c) may preferably involve that the substance is displaced through at least one nozzle-like means for increasing flow speed when stirring. By increasing the flow speed the stirring effect is improved and thereby also heat transfer to or from the substance. By having several nozzles or nozzle-like means at different positions and of different sizes, the stirring can be very controlled so that a mixing of heated substance with non-heated substance can be obtained in all parts of the tank, and even in the corners the furthest away from the heat exchanger. In the simplest design the nozzles can be holes.

The external source means may in a preferred embodiment comprise means for heating water. Means for heating water are generally available at a relatively low cost. Water is neutral to the environment, and in case an amount of water should accidentally be leaked no harm will be done.

The method may preferably be utilised in a way where the substance is initially in an at least partly solidified state, and where heat is exchanged between the heat exchanger and the substance according to step a), at least until an amount of the substance is melted, before commencing of steps b) and c). The method is particularly suitable for melting a partly solidified substance A preferred use of the method is for melting edible solidified oil or fat. Oil or fat of e.g. vegetable origin is often produced near plantations, or in process plants, in locations far distant from where they are used. They are therefore transported by ship and may be days or weeks on the way, which gives adequate time to be cooled by the ambient temperature to a temperature below the melting temperature. In order to empty containers storing such oil or fat, the oil or fat must be melted to allow draining or pumping.

Furthermore, as the heat exchanger is placed inside the container, the apparatus requires only a minimum of space both during the transportation of the container and during the heating process itself. The heating method can thus be used even where the free space is limited. Furthermore, the heat exchanger according to the invention only enters and is mounted on the container in one place, and access to the other sides of the container is therefore not necessary. This is also very advantageous when used on a substance like e.g. edible oils or fat initially poured onto a flexitank placed inside a shipping container for extra stability and strength during transport. Here, the access to the flexitank is then limited to only the one side of the flexitank just inside the ports of the container, but using the described invention this will not cause any problems.

The invention further relates to an apparatus for increasing the temperature of a substance where the substance is initially in an at least partly solidified state in a container, said apparatus comprising at least one heat exchanger adapted to exchange heat with the substance, when the heat exchanger is arranged in a container, where the apparatus further comprises pumping and guiding means for displacing the substance in the container, said pumping and guiding means being adapted to stir the substance and to increase heat exchange between the heat exchanger and the substance, when the substance is displaced. When heat is exchanged between the substance and the heat exchanger in the container, and the substance is displaced by the pumping and guiding means to stir the substance, then not only stagnant substance is in contact with the heat exchanger for heat exchange, whereby heat exchange is greatly improved. The amount of substance in contact with the heat exchanger is increased, and the heat exchange is less dependent on thermal conductivity of the substance.

Preferred embodiments of the apparatus is described in the text of the detailed description section.

The invention further relates to a system comprising a container adapted for storing a substance, a heat exchanger arranged with at least one oblong cylindrical surface inside the container and guiding means adapted to guide a substance along said surface of the heat exchanger, said guiding means comprising a housing arranged essentially concentrically around said heat exchanger and being adapted to receive a flow of substance, where the housing is comprising a number of openings arranged in a pattern along the length of said housing to distribute said flow of substance when present.

Preferred embodiments of the system is described in the text of the detailed description section.

The invention further relates to a heat exchanger comprising an oblong and substantially cylindrical section adapted for heat exchange with a substance, where guiding means comprising a housing are arranged essentially concentrically around said heat exchanger and adapted to receive and guide a flow of said substance along said section, and where the housing comprises a number of openings arranged in a pattern along the length of said housing to distribute said flow of substance when present.

Preferred embodiments of the heat exchanger is described in the text of the detailed description section.

In the following the invention is described with reference to the drawings, which display examples of embodiments of the invention.

Figure 1A:
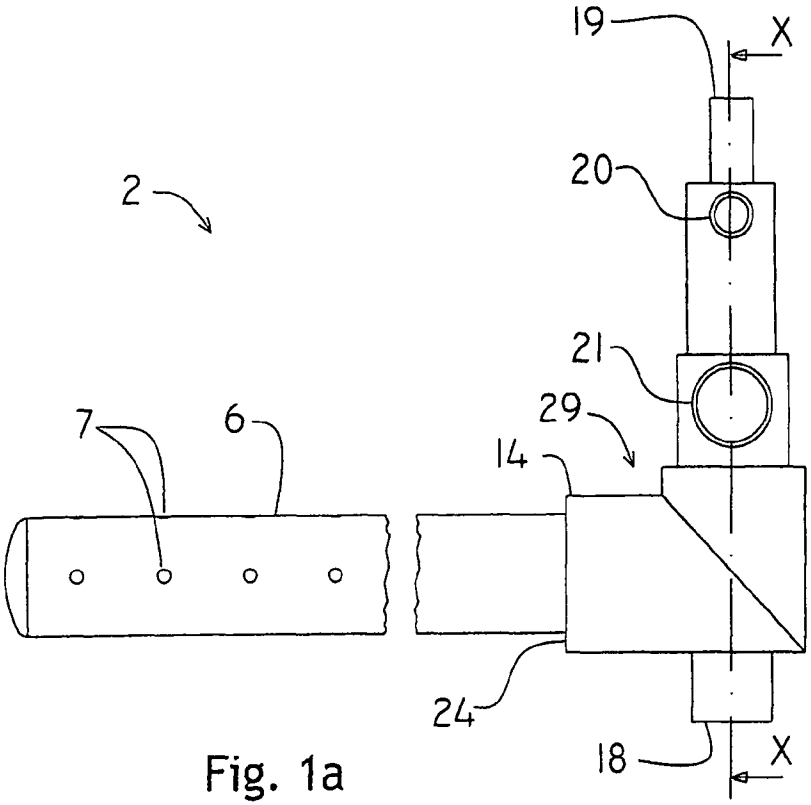
Figure 3:
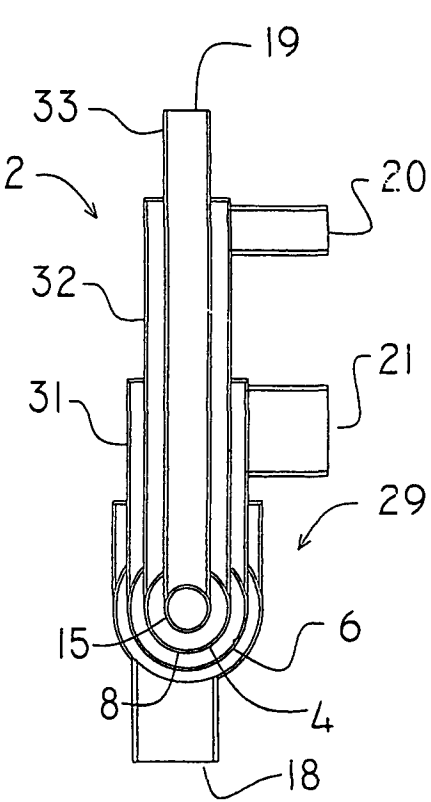
Figure 2:
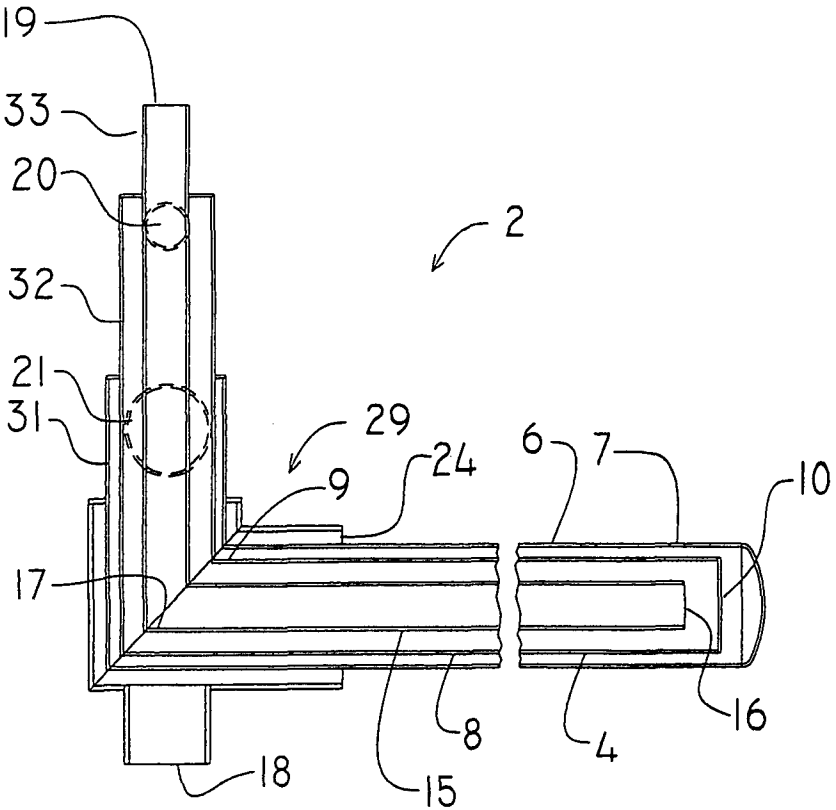
Figure 4:
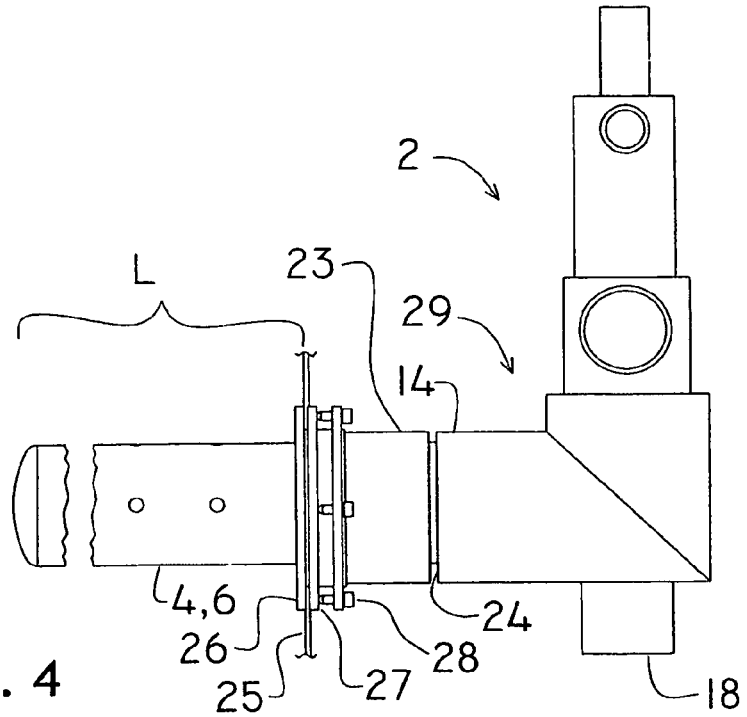
Figure 5B:
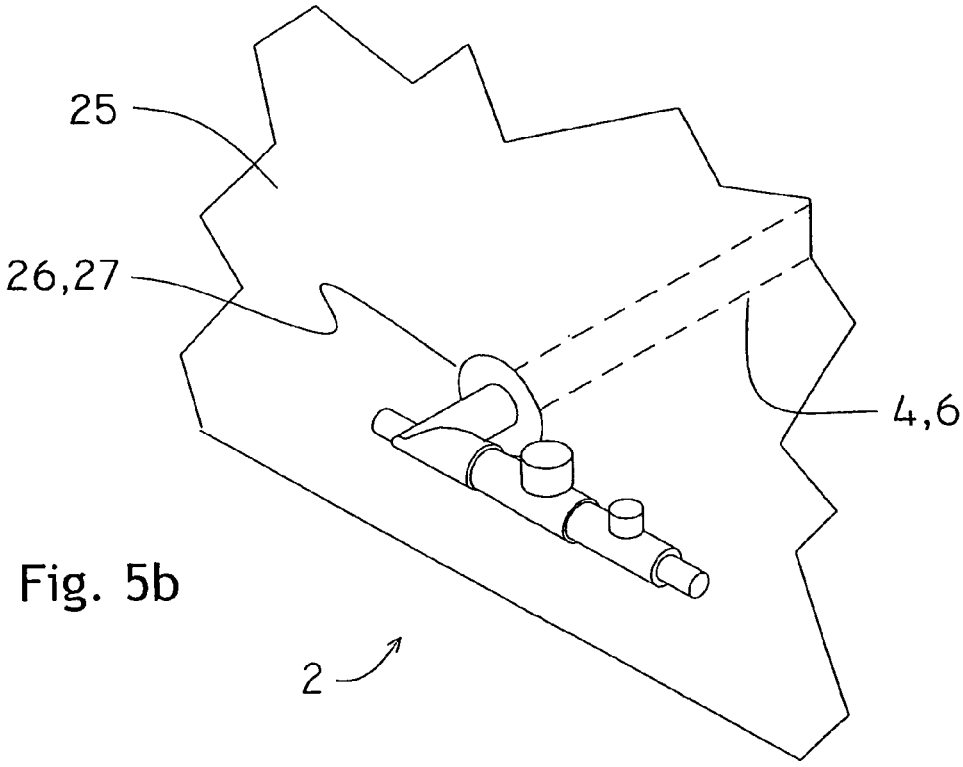
Figure 5A:
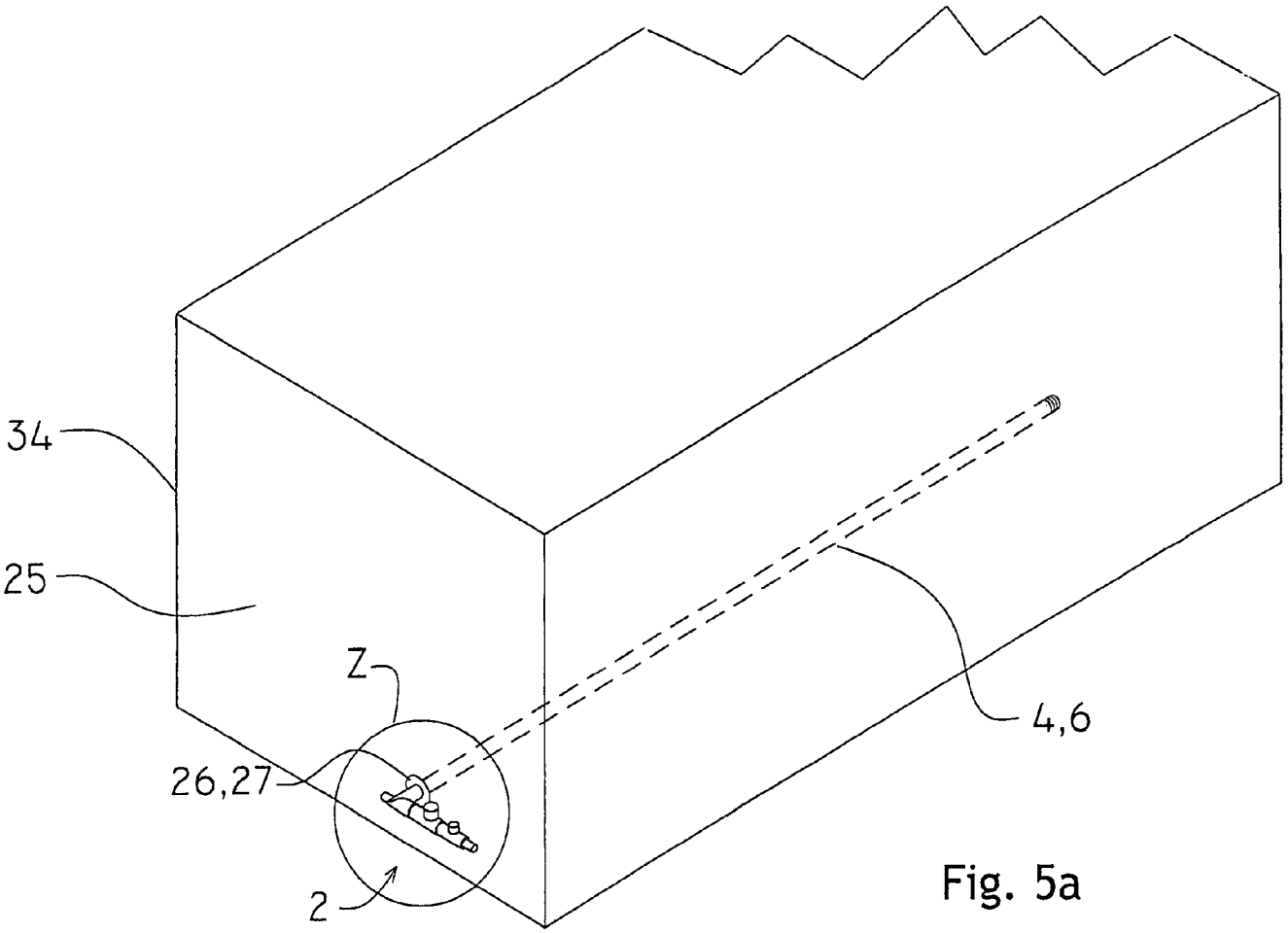
Figure 6:
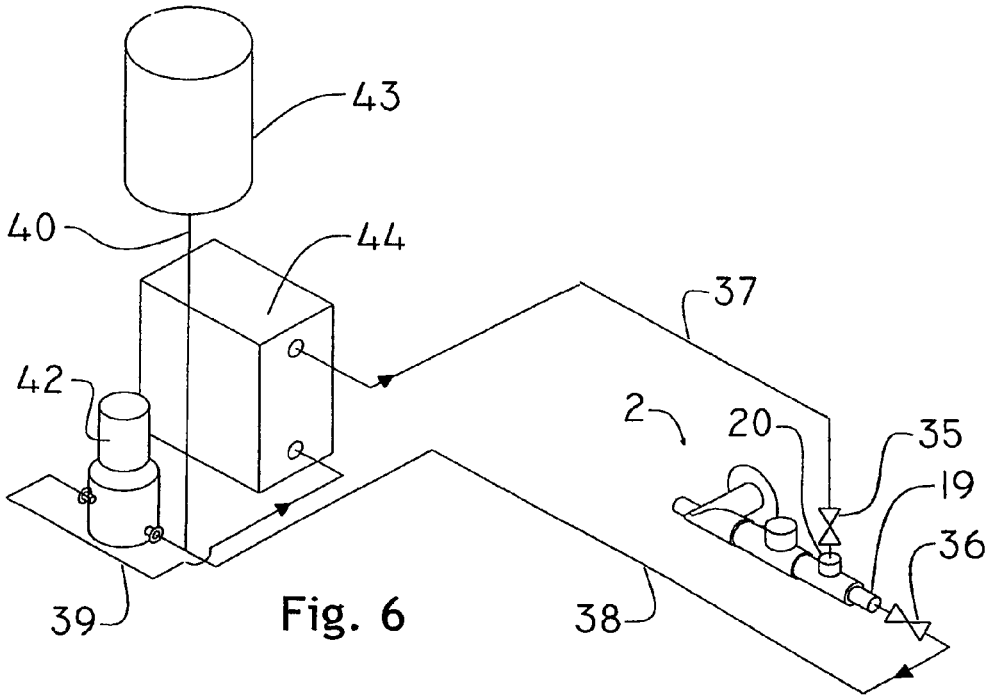
Figure 7:
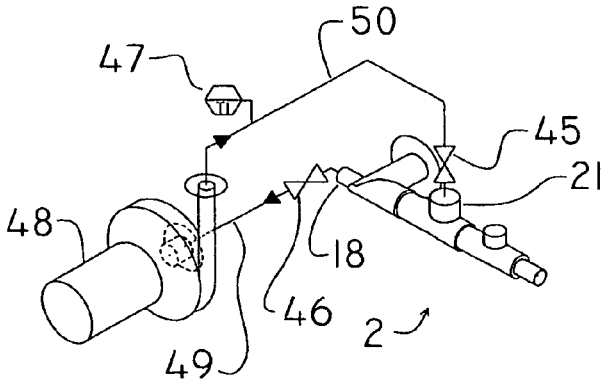
Figure 8:
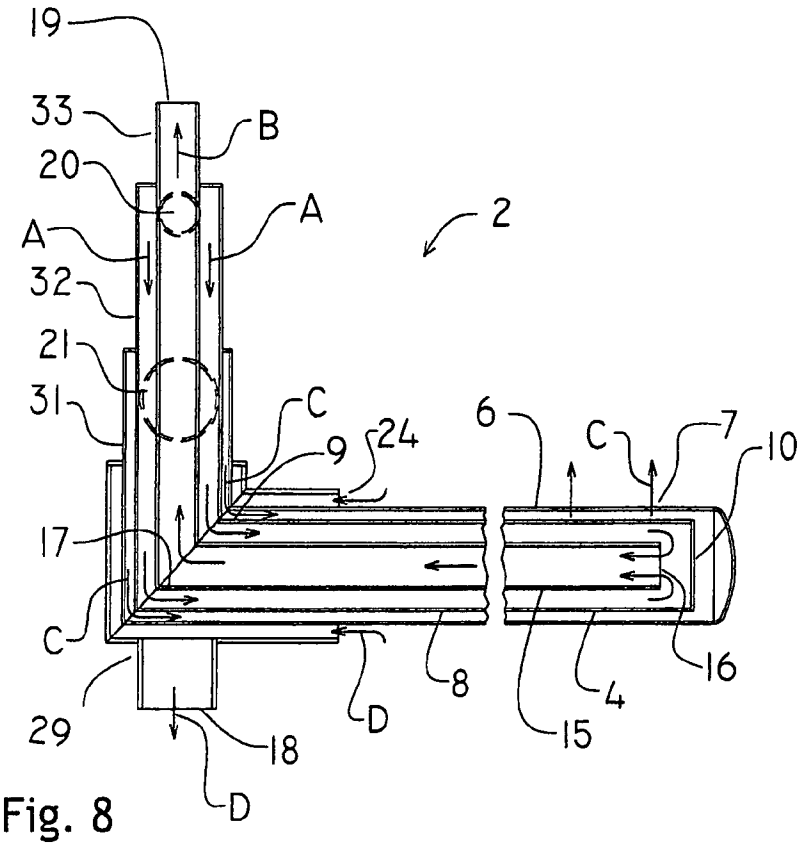

FIG. 1*a* shows side view of a heat exchanger according to the invention,

FIG. 1*b* shows a front view of the heat exchanger displayed in FIG. 1*a*, FIG. 2 shows section Y-Y of FIG. 1*b*, FIG. 3 shows section X-X of FIG. 1*a*, FIG. 4 shows a sectional side view of a heat exchanger installed in a container FIG. 5*a* shows an elevated view of a heat exchanger installed in a container FIG. 5*b* shows detail Z of FIG. 5*a* in enlarged format FIG. 6 shows a simplified circuit for recycling a heat transferring media to a heat exchanger FIG. 7 shows a simplified circuit for recycling a substance FIG. 8 shows a sectional view corresponding to FIG. 2, where the directions of flow of a heat transferring media and of a substance are indicated.

Figure 9:
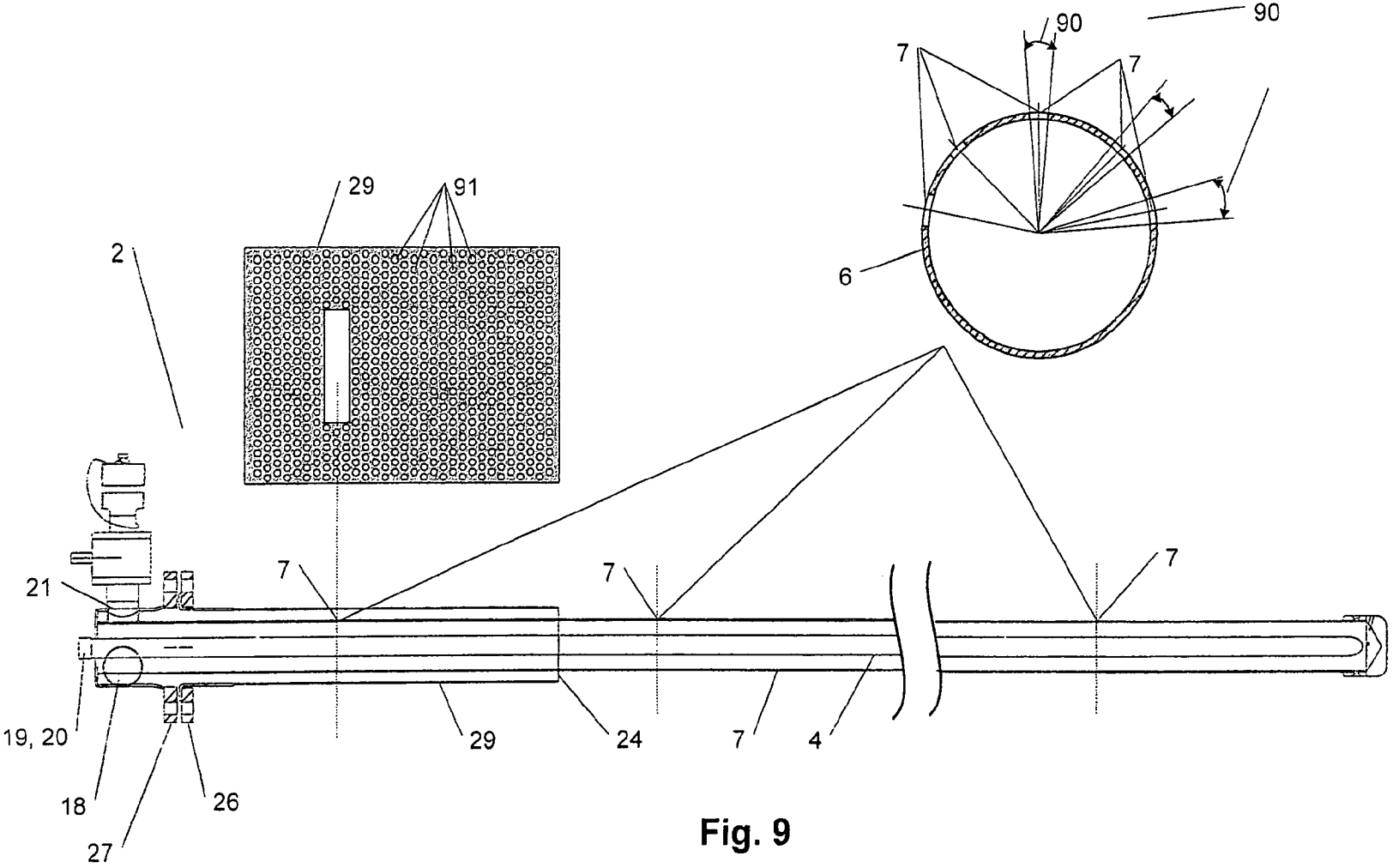

FIG. 9 shows an embodiment of a heat exchanger according to the invention.

Figure 10C:
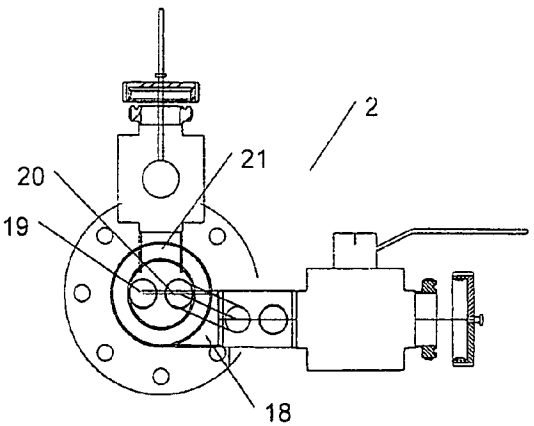
Figure 10A:
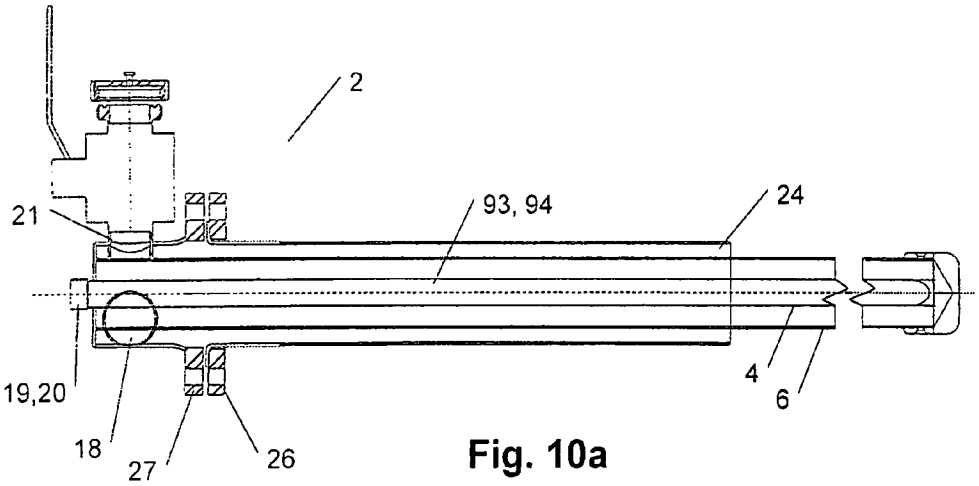

FIG. 10*a* shows an embodiment of a heat exchanger according to the invention as seen in a side view.

Figure 10B:
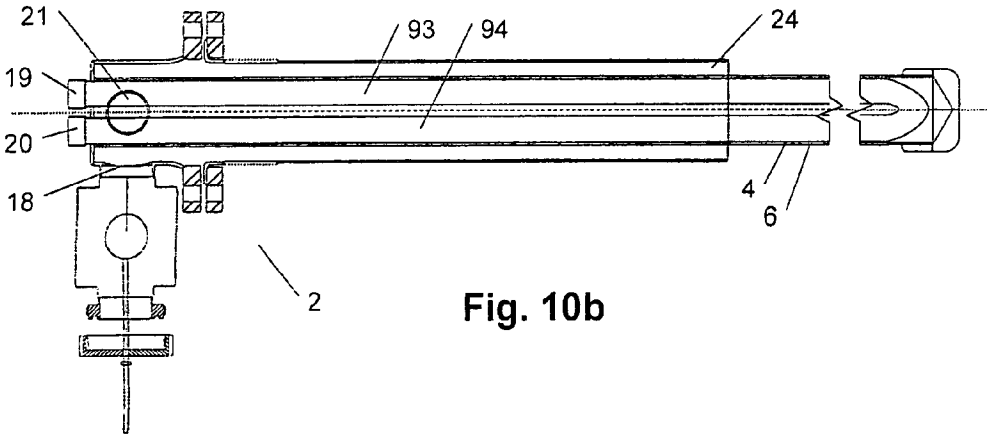

FIG. 10*b* shows the heat exchanger of FIG. 10*a* as seen in a top view.

FIG. 10*c* shows the heat exchanger of FIG. 10*a* as seen in an end view.

A number of different pipes are shown in the figures and are displayed without weldings, brazings etc. for connecting and assembling said pipes. Such connections are, however, trivial for the skilled person and hence left out for simplification. The relative dimensions of the heat exchanger in FIGS. 1-3 and 9-10 are displayed essentially in scale.

FIG. 1*a* and 1*b* display a heat exchanger 2 comprising guiding means, which include a housing 6 with openings 7. The heat exchanger 2 further comprises openings 18, 19, 20, 21 and 24. Openings 19 and 20 are adapted for connection of source means for transferring heat to or from the heat exchanger, e.g. heated water or steam recycled to the heat exchanger 2 via the openings. To form internal flow paths in the heat exchanger 2, pipe sections 31-33 are provided. The heat exchanger further comprises an outlet part 29 having an opening 24, which is connected to the opening 18. The outlet part 29 comprises a cylindrical section 14 adapted to receive a coupling.

FIGS. 2 and 3 display a heat exchanger 2 comprising an oblong cylindrical section 4 formed by a pipe 8 with a first end 9 and a closed second end 10. The pipe 8 is connected to a pipe 32 and from thereon to an opening 20. Inside the pipe 8 a second pipe 15 is arranged having an open first end 16 placed by the closed first end 10. The pipe 15 is by a second end 17 connected to a pipe 33, which extends upwards into an opening 19. The pipe 8 is concentrically surrounded by guiding means, which here is a housing 6 formed by a pipe having a number of openings 7, said openings preferably pointing upwards and sideways. The housing 6 is connected to a pipe 31 and from thereon to an opening 21. An outlet part 29 is attached around the housing 6 and comprises an opening 24. The outlet part 29 further comprises a connection to an opening 18.

FIG. 4 displays a heat exchanger 2 having a housing 6 and an oblong cylindrical surface 4 as well as an outlet part 29 comprising a cylindrical section 14. The heat exchanger 2 is attached to a wall 25 of an undisplayed container with the housing 6 and the surface 4 extending a length L into the container. The length L preferably corresponds essentially to the length/depth/width of the container in order to enhance the function of the heat exchanger when activated. The heat exchanger 2 is connected to a pipe 23 with an undisplayed coupling e.g. Straub, which effectively closes any gap between the pipe 23 and the cylindrical section 14 of the outlet part 29. The pipe 23 is connected to flanges 27 and 26, which are attached to the wall 25. Bolts 28 are used for attaching the pipe 23. In this way an undisplayed opening 24—see e.g. FIG. 2—may receive substance from the container via the pipe 23. In FIGS. 5*a* and 5*b* a heat exchanger 2 is attached via flanges 26 and 27 to a wall 25 of a container 34. A housing 6 and an oblong cylindrical surface 4 is extending into the container 34.

FIG. 6 displays a heat exchanger 2 placed as depicted in FIGS. 5*a* and 5*b*. A container 34, housing 6 and an oblong cylindrical surface 4 are left out for simplicity. A heat transferring media is heated in a boiler e.g. oil-fired 44 and via a connection 37 transported to an opening 20. Cut-off valves 35 and 36 are provided by the openings 19 and 20. The heat transferring media is exited through an opening 19 and transported to a transfer pump 42 via a connection 38. From the transfer pump the heat transferring media is transported back to the boiler 44 via a connection 39. An expansion vessel 43 is connected to the connection 38 via a connection 40. Various fittings, valves etc., which are trivial to the skilled person are omitted for simplicity. The transport direction of the heat transferring media through the heat exchanger may of course be reverse.

In FIG. 7 substance is pumped from a centrifugal pump 48 to an opening 21 in the heat exchanger 2 via a connection 50. Cut-off valves 45 and 46 are provided by the openings 18 and 21. A temperature gauge 47 is monitoring the temperature of the substance. Substance from the container is exited through the opening 18 and remitted to the centrifugal pump 48 via a connection 49. Various fittings, valves etc., which are trivial to the skilled person are also here omitted for simplicity.

It is to be understood that the external items displayed in both FIGS. 6 and 7 will be connected simultaneously for operating the heat exchanger 2. The use of two separate figures is for simplicity only. Means for controlling the boiler 44, the transfer pump 42 and the centrifugal pump 48 are not displayed.

In a further embodiment of the invention an extra heat exchanger can be applied to the external system, either before or after the pumping means, in this way accelerating the heating process.

FIG. 8 displays a heat exchanger 2 comprising an oblong cylindrical section 4 formed by a pipe 8 with a first end 9 and a closed second end 10. The pipe 8 is connected to a pipe 32 and from thereon to an opening 20. Inside the pipe 8 a second pipe 15 is arranged having an open first end 16 placed by the closed first end 10. The pipe 8 is by a second end 17 connected to a pipe 33, which extends upwards into an opening 19. A heat transferring media is entered through the opening 20 and conveyed in the direction indication by the arrows A. By the closed second end 10 of the pipe 8, the direction of the heat transferring media is reversed to enter the second pipe 15 by its first open end 16. The heat transferring media is exited through the opening 19 in the direction indicated by the arrow B. The pipe 8 is concentrically surrounded by guiding means, which here is a housing 6 formed by a pipe having a number of openings 7, said openings preferably pointing upwards and sideways. The housing 6 is connected to a pipe 31 and from thereon to an opening 21. Substance is entered via the opening 21 and conveyed towards the openings 7 in the housing 6, from where the substance is displaced away from the heat exchanger 2. The directions of flow are indicated by the arrows C. The substance is hereby first allowed to exchange heat with the heat transferring media via the surface 4, where after it is displaced through the openings 7 to obtain a stirring effect in substance surrounding the heat exchanger. An outlet part 29 is attached around the housing 6 and comprises an opening 24. The outlet part 29 further comprises a connection to an opening 18. Substance surrounding the heat exchanger may hereby be drained through the opening 18 via the opening 24 in the outlet part 29. The openings 7 may be provided with nozzles to increase the speed of the substance to enhance the stirring effect.

Normally a heat exchanger 2 is mounted in a container, such as a flexitank made essentially from a polymeric material. Cut-off valves are mounted in the openings 18-21. A pumpable substance is then filled into the container preferably via the opening 18, or alternatively via an opening in the top of the container. Trapped air in the container is vented e.g. by use of a bleed valve. After filling the container, the outlet part 29 and the housing 6 will be filled with the substance. The container may then be put in a storage room or transported to a different location, where the substance in time may solidify to a non pumpable consistency. If this is the case then a heated media, e.g. hot water, is circulated for a certain period of time through the pipes 8 and 15 as described above with respect to FIG. 8. This reconstitutes at least the substance in the housing 6 and the outlet part 29 to a pumpable viscosity, and circulation of the substance is initiated. The circulation of the substance is described above with respect to FIG. 8. When the substance exits the openings 7 in the housing 6, the pressure within the housing is transferred into kinetic energy of the fluid. The substance is here displaced at a speed depending on the pressure added by the pump and in substantially radial directions relative to the housing. In this way the heat exchanged substance may influence solidified substances in a distance away from the heat exchanger 2 and thereby improve heat transfer. The direction in which and the speed by which the substance is displaced is controlled by the placing and the dimensioning of the openings 7. In this way a stirring effect is obtained, just as it is obtained that the heated substance is mixed with the remaining substance not only just around the heat exchanger but in the entire tank. This greatly improves the heat transfer compared to transferring heat trough a stagnant substance. The stirring effect can be obtained by shaping the openings 7 as holes relatively small compared to the dimensions of the pipe. The opening could also be provided with nozzles to increase the kinetic energy of the displaced substance even further. After having obtained a proper viscosity of some or all of the substance, a desired amount of the substance may be removed from the container, e.g. by pumping or by use of gravity, such as by tilting the container.

As an alternative to circulating a heat transferring media in the heat exchanger, the heat exchanger may be provided with a built-in electrical heating element.

In FIG. 9 is shown an embodiment of a heat exchanger 2 according to the is present invention. As in the earlier embodiments the heat exchanger 2 comprises an oblong cylindrical section 4 extending into the interior of the container (not shown) similarly as illustrated in FIG. 5*a* and of a total length corresponding to the dimensions of the container. The heating media flows within the oblong cylindrical section 4 heating the substance in the housing 6 surrounding the cylindrical section 4. The heating media, e.g. water or steam, enters and leaves the heat exchanger trough the openings 19, 20. The pumped substance enters the housing 6 through the opening 21 and leaves the housing 6 via a number of openings or holes 7 working as nozzles changing the pressure energy of the substance within the housing into kinetic energy. A cross section of the housing 6 is shown in an enlargement in the figure. Here the placing of the openings 7 can be seen in details. Such holes (of which only a few are shown here for clarity) are placed at a number of positions along the entire length of the housing 6. The positions and the sizes of the holes determine the resulting direction of the displaced substance along with its velocity. The holes are therefore placed so as to obtain a maximum stirring and mixing of the substance everywhere in the container. As the heat exchanger 2 shown in FIG. 9 is designed to be mounted near the bottom of a container and a little to one side, the holes 7 are placed in the upper side of the housing 6. Furthermore, the diameter of an opening 90 is designed to obtain the highest velocity of the displaced substance where the distance from the opening to the container wall is the longest. To further enhance the nozzle effect of the openings, the edges of the openings can be laser cut whereby burrs are avoided.

As described earlier, the substance is extracted from the container via the opening 24 in the outlet part 29 and leaves the heat exchanger through the opening 18. In this embodiment the outlet part 29 reaches a distance into the container and is equipped with numerous small holes 91 which can be seen from the unfolded view inserted into FIG. 9. The small holes prevent the outlet part 29 from collapsing or folding due to the pressure difference between the substance inside and outside the outlet part. The heat exchanger 2 is mounted on the container at the flanges 26 and 27 by conventional means, such as bolts or the like.

A similar embodiment of a heat exchanger 2 is shown in the FIGS. 10*a-c* in a side, top and end view, respectively. The substance enters and leaves the heat exchanger in the same way as described to FIG. 9. In this embodiment the heating media runs via the opening 19 through one pipe 93 connected to a second pipe 94 essentially parallel to the first one and exits through the opening 20. This is seen the most clearly in FIG. 10*b*. The pipes 93, 94 run within the housing 6 in its entire length. This alternative embodiment is advantageous in yielding a high heating efficiency and is simple and inexpensive to manufacture.

EXAMPLE 1

A 1×1×1 m steel tank with a volume of 1 $m^3$ is provided with a heat exchanger having a design corresponding to FIGS. 1-3 and 8. The housing 6 is made from a steel pipe 83×80 mm (internal diameter 80 mm and external diameter 83 mm). The pipe 8 is made from a steel pipe 63×60 mm, and the pipe 15 is made from a steel pipe 32×30 mm. The length L is 0.9 m, and the housing 6 is provided with two openings 7 facing upward and four openings 7 sideways (two in each side), said opening 7 having a 10 mm diameter. In the steel tank 800 kg Confao™35 was filled (supplier: Aarhus United, 8000 Aarhus, Denmark). Confao™35 is a confectionery fat based on hydrogenated vegetable oils of non-lauric origin, with the following typical values:

Slip melting point=37° C. (according to AOCS Cc 3-25)

Trans fatty acids=43% (according to IUPAC 2.304)

Vegetable oils typically have the following heat related values:

Liquid fats: specific heat contents=2.1 kJ/(kgK)

Melting heat=185-210 kJ/kg

After filling the tank is stored for three days in a storage room having a temperature of 5 degrees Celsius, whereby the oil is solidified. Heated water used as heat transferring media is circulated in the heat exchanger as described with respect to FIG. 6. After solidified oil in the heat exchanger is melted, displacement and circulation of the melted oil is commenced and continued until all oil is melted and a uniform temperature of the oil is obtained.

Three runs were performed with a temperature of the heat transferring media (water) of 90° C., 75° C. and 65° C., respectively. The flow rate of the water through the heat exchanger was approximately 1 liter/second. A fourth run was performed with steam as the heat transferring media, at a pressure of 1.8 bar and having a temperature of 131° C. By all four runs the temperature of the oil in the tank was registered at the beginning and at the end. Also the time used was registered.

TABLE 1

Results of test runs.

| Temperature of heat transferring media | Oil start temp. [° C.] | Oil finish temp.* [° C.] | Time for melting [hours] |
|---|---|---|---|
| 90° C. water | 11.9 | 39.5 | 6.33 |
| 75° C. water | 11.9 | 38.1 | 8.33 |
| 65° C. water | 11.9 | 36.4 | 10.50 |
| 1.8 bar steam | 9.7 | 36.4 | 3.33 |

*Temperature of the oil at the time all oil is melted, which is determined by visual inspection.

EXAMPLE 2

A 24,000 l. multi-ply, single use flexitank from Braid & Co was placed in a 20' dry container. The flexitank was fitted with a heat exchanger as illustrated in FIG. 5*a*. The heat exchanger (cf. FIG. 8) had a length of 5.3 meters, and the diameter was 84 mm. The outer cylindrical housing had twenty 10 mm openings evenly distributed at the two sides and the upper part to distribute the flow of material.

The flexitank was then filled with 17.5 metric ton of Shokao™ 94 (Aarhus United Denmark). Shokao™ 94 is a cocoa butter replacer based on fractionated and unhydrogenated non-lauric oil, with a melting point of 32° C. The fat is polymorphic and behaves like cocoa butter. To cool and crystallise the fat, the container was placed outdoor for six weeks at an average temperature of approx. 2° C. The heat exchanger was adapted with heating means as illustrated in FIG. 6. The pump, pos. 42, was a Grundfoss CP8-40 adjusted to circulate water in a flow rate of 11 $m^3$/h. Further, the heat exchanger was adopted with circulating means as illustrated in FIG. 7. The pump, pos. 48, was a KSB Etachrom BC032-125/302 adjusted to a flow rate of 15 $m^3$/h. Temperature probes were installed in the lines for circulating water and test material. Likewise, a probe was installed in the top of the flexitank. All temperatures were recorded simultaneously at 10-minutes intervals.

The test was commenced on the 24 Feb. 2004 and the start up procedure was as described in Example 1. The following results were obtained:

| Time in hours | Temperature of heating water in ° C. | Temperature of the circulating oil in ° C. | Temperature at the top of the flexitank in ° C. |
|---|---|---|---|
| 5 | 80.4 | 42.9 | 7.7 |
| 10 | 80.4 | 39.3 | 5.7 |
| 15 | 71.0 | 39.3 | 4.6 |
| 20 | 77.7 | 39.3 | 4.6 |
| 25 | 80.4 | 39.3 | 8.4 |
| 30 | 75.0 | 39.3 | 14.5 |
| 35 | 72.3 | 39.3 | 32.2 |
| 40 | 72.3 | 39.3 | 33.3 |
| 45 | 76.3 | 40.5 | 34.1 |
| 50 | 72.3 | 42.9 | 36.5 |

In the time interval from 10 to 40 hours the melting is in a steady state as indicated by a constant temperature of the circulating oil. Furthermore, it can be seen that the bulk of material is melted in the time interval from 35 to 40 hours as indicated by a temperature on or above the melting point of the material at the top of the flexitank. On inspection it was revealed that a layer of only approx. 1 cm. solid material was left at the remote end of the flexitank.

At the end of the test, the substance was drained out, leaving approximately 30 kg of substance in the flexitank.

EXAMPLE 3

This example is basically a continuation of example 2, with the exception that the heat exchanger and stirring unit is optimised, and an external heat exchanger has been incorporated in the circuit of the melted substance in order to increase the heat transfer. Furthermore, the substance was moved to another continent to prove the industrial applicability of the invented concept used on a substance of food grade quality that is prone to degrade during handling.

A 24,000 l. multi-ply, single use flexitank from Braid & Co was placed in a 20' dry container. The flexitank was fitted with a heat exchanger and stirring unit as illustrated in FIG. 5*a*. The heat exchanger (see FIGS. 9 and 10*a-c*) had a length of 5.3 meters and the diameter was 76 mm. The outer cylindrical housing had thirty-five openings or holes serving as simple nozzles evenly distributed at the two sides and the upper part at positions along the length of the housing to distribute the flow of material. The openings in the housing were of different diameter and positioned to secure a thorough stirring effect of the substance (cf. FIG. 9). The flexitank was then filled with 20.5 metric ton of Illexao™ 30-61 (Aarhus United Denmark). Illexao™ 30-61 is a cocoa butter equivalent based on fractionated and unhydrogenated, exotic oils, with a slip melting point of 34° C. The fat is polymorphic and behaves like cocoa butter. After cooling the container was shipped as normal container cargo to Brazil. Upon arrival, the container was placed in a roofed area, and the heat exchanger was adapted with heating means as illustrated in FIG. 6 and in the circuit of the circulating melted substance an external heat exchanger was inserted (FIG. 7).

The heating and melting of the substance was performed at the following parameters:

Surrounding temperature—approximately 20° C. (night) and 35° C. (daytime)

Flow rate of heating water—12 $m^3$/h.

Flow rate of circulating melted substance—1 $\mu m^3$/h.

Temperature probes were installed in the lines for circulating water and melted substance. Likewise a probe was installed in the top of the flexitank. All temperatures were recorded simultaneously at 3-minute intervals. The test was commenced on the 11 Jan. 2005 and the start up procedure was as described in Example 1. The following results were obtained:

| Time in hours | Temperature of heating water* in ° C. | Temperature of the circulating substance in ° C. | Temperature at the top of the flexitank in ° C. |
|---|---|---|---|
| 5 | 80 | 30 | 30 |
| 10 | 80 | 53 | 30 |
| 15 | 80 | 51 | 30 |
| 20 | 80 | 53 | 52 |
| 22.5 | 80 | 57 | 57 |
| 25 | 80 | 63 | 65 |

*Thermostat interval ±10° C.

In the time interval from 10 to 20 hours the melting is in a steady state as indicated by a constant temperature of the circulating oil. Furthermore, it can be seen that the bulk of material is melted after 20 hours as indicated by an almost identical temperature of the circulating substance and at the top of the flexitank. After unloading the melted substance an inspection revealed that less than 25 kg was left in the flexitank.

Analytical values measured before loading and after melting proved that the substance had not suffered in quality by the complete handling procedure. Only insignificant oxidative or thermal degradation was recorded.

EXAMPLE 4

Reference

This example is a reference example based on the state of the art procedure in current use at the time of this invention.

Here, a 24,000 l. multi-ply, single use flexitank is placed in a 20' dry container on top of a heating blanket also known as heat pads. The flexitank is then filled with Cebes™ 30-86 (Aarhus United Denmark). Cebes™ 30-86 is a cocoa butter substitute based on fractionated and hydrogenated palm kernel oil, with a slip melting point of 35° C. After cooling, the container is shipped as normal container cargo to Australia.

Upon arrival, the tubes of the heating pads are connected to loops of circulating heating water. The heating and melting of the substance is performed at the following parameters:

Flow rate of heating water-2.5 $m^3$/h with a pressure drop of 2.3 bar.

Inlet temperature of heating water 85° C.

Outlet temperature of heating water 60° C.

The heating is continued until all material is in a liquid state and ready for discharge. The following results are the average recordings based on approximately 240 deliveries as described above.

| Parameter | Summer | Winter |
|---|---|---|
| Ambient day temperature | 28° C. | 15° C. |
| Ambient night temperature | 15° C. | 3° C. |
| Melting time in hours | 70 | 90 |

From the results it is obvious that this method of handling bulk liquids, that are solid at ambient temperature, is both ineffective and thus correspondingly expensive.

DEFINITION

Wherever a substance is mentioned in the present context, this is to be understood in a broad sense comprising any material or combination of materials, which at least in one condition has a viscosity/consistency where the substance is displaceable by known pumping means. A non exhaustive list of such substances includes:

vegetable oils or fats
edible oils or fats
fatty alcohols
polyglycols
petroleum jelly
paraffin wax
natural or synthetic rubber
resins It is to be understood that the invention as disclosed in the description and in the figures may be modified and changed and still be within the scope of the invention as claimed hereinafter.

The invention claimed is:

1. A method for increasing the temperature of a substance in a container, wherein the container is configured to hold a partly solidified substance and a melted substance and where at least one heat exchanger comprising guiding means is positioned in the container, said guiding means comprising a housing, said housing comprising a plurality of openings arranged in a pattern along the length of said housing and where pumping means is connected to said guiding means, said pumping means comprising a pump positioned external of the container, said method comprising the steps of:

a) exchanging heat between the heat exchanger and the partly solidified substance stored in the container, b) displacing by pumping means and guiding means the heat exchanged melted liquid substance through the plurality of openings, thereby stirring the substance and circulating the melted liquid substance and increasing flow speed and increasing heat exchange between the heat exchanger and the substances, and further increasing heat exchange between the heat exchanged melted liquid substance and the remaining substance in the container.

2. A method according to claim 1, where the heat exchanger is connected to external source means for transferring heat to the substance in the container, and where the source means and the pumping means are coordinated by control means for controlling the temperature of the substance.

3. A method according to claim 2, where the external source means comprise means for heating water.

4. A method according to claim 1, where the heat exchanger comprises an oblong cylindrical surface, and where the guiding means are provided for guiding the substance along said surface when performing step b).

5. A method according to claim 4, where the housing is arranged essentially concentrically around the heat exchanger.

6. A method according to claim 1, where heat is exchanged between the heat exchanger and the substance according to step a) at least until an amount of the substance is melted, before commencing steps b).

7. A method according to claim 1, where the substance is edible solidified oil or fat.

* * * * *